US008082749B2

(12) United States Patent
Sekine et al.

(10) Patent No.: US 8,082,749 B2
(45) Date of Patent: Dec. 27, 2011

(54) AIR CONDITIONER

(75) Inventors: Takashi Sekine, Ota (JP); Kenji Kobayashi, Ota (JP); Naoki Sakamoto, Ora-gun (JP)

(73) Assignee: SANYO Electric Co., Ltd., Moriguchi-shi (JP)

( * ) Notice: Subject to any disclaimer, the term of this patent is extended or adjusted under 35 U.S.C. 154(b) by 513 days.

(21) Appl. No.: 12/170,572

(22) Filed: Jul. 10, 2008

(65) Prior Publication Data

US 2009/0019884 A1 Jan. 22, 2009

(30) Foreign Application Priority Data

Jul. 17, 2007 (JP) ..... 2007-185224

(51) Int. Cl.
*F25B 27/00* (2006.01)

(52) U.S. Cl. ..... 62/238.6; 62/515; 62/324.6; 62/238.7; 62/199; 62/200

(58) Field of Classification Search ..... 62/515, 62/324.6, 238.6, 238.7, 199, 200
See application file for complete search history.

(56) References Cited

U.S. PATENT DOCUMENTS

| | | | | |
|---|---|---|---|---|
| 7,261,243 | B2 * | 8/2007 | Butler et al. | 236/1 C |
| 2005/0066678 | A1 * | 3/2005 | Kamimura | 62/238.7 |
| 2006/0005558 | A1 * | 1/2006 | Otake et al. | 62/260 |

FOREIGN PATENT DOCUMENTS

| | | |
|---|---|---|
| EP | 1275913 | 1/2003 |
| EP | 1521046 | 4/2005 |
| EP | 1607695 | 12/2005 |
| EP | 1607696 | 12/2005 |
| EP | 1617158 | 1/2006 |
| EP | 1775528 | 4/2007 |
| JP | 2-279962 | 11/1990 |
| JP | 02279962 | 11/1990 |

* cited by examiner

*Primary Examiner* — Cheryl J Tyler
*Assistant Examiner* — Jonathan Koagel
(74) *Attorney, Agent, or Firm* — Westerman, Hattori, Daniels & Adrian, LLP

(57) ABSTRACT

An air conditioner having a heat-source side unit including a compressor and a heat-source side heat exchanger, plural use-side units each having a use-side heat exchanger and an inter-unit pipe for connecting the heat-source side unit to the plural use-side units, including an auxiliary heat source unit having a water-refrigerant heat exchanger for heat-exchanging refrigerant with water, a refrigerant side of the water-refrigerant heat exchanger being selectively connectable to one of the high-pressure gas pipe and the low-pressure gas pile through one of a first change-over valve and a second change-over valve, and also connected to a liquid pipe through an expansion valve, and a controller for controlling the auxiliary heat source unit so that the water-refrigerant heat exchanger of the auxiliary heat source unit functions as an evaporator with a water side thereof serving as a heat source when some of the user-side units are under heating operation.

6 Claims, 10 Drawing Sheets

D1

| P1 [kW] | x [℃] |
|---|---|
| P1A | xA |
| P1B | xB |
| P1C | xC |
| ----- | ----- |
| ----- | ----- |
| ----- | ----- |
| ----- | ----- |
| ⋮ | ⋮ |
| ----- | ----- |

AIR CONDITIONER

INCORPORATION BY REFERENCE

The present application claims priority under 35 U.S.C. §119 to Japanese Patent Application No. 2007-185224 filed on Jul. 17, 2007. The content of the application is incorporated herein by reference in its entirety.

BACKGROUND OF THE INVENTION

1. Field of the Invention

The present invention relates to an air conditioner in which a heat-source side unit having a compressor and a heat-source side heat exchanger is connected to plural use-side units each having a use-side heat exchanger by an inter-unit pipe so that the use-side units can perform cooling operation or heating operation at the same time and individually and independently perform any one of cooling operation and heating operation in a mixing mode.

2. Field of the Invention

There is known an air condition in which in which a heat-source side unit having a compressor and a heat-source side heat exchanger is connected to plural use-side units each having a use-side heat exchanger by an inter-unit pipe so that the use-side units can perform cooling operation or heating operation at the same time and individually and independently perform any one of cooling operation and heating operation in a mixing mode.

In this type of air conditioner, a water-refrigerant heat exchanger for heat-exchanging water and refrigerant is disposed as the heat-source side heat exchanger in the heat-source side unit, and water heated by a boiler (auxiliary heat source) is made to flow to the water side of the water-refrigerant heat exchanger under the heating operation of the use-side unit, thereby enhancing the evaporation capacity of the heat exchanger (for example, see JP-A-2-279962).

However, in the air conditioner disclosed in the above publication, the heat-source side unit is disposed outdoors, and the water-refrigerant heat exchanger is disposed in the heat-source side unit. Therefore, the water-refrigerant heat exchanger and a waster pipe are more cooled by outside air as the temperature of the outside air is lower. Under heating operation, that is, under low outside air temperature, hot water from boiler is supplied to the water-refrigerant heat exchanger, so that the hot water is cooled by the outside air and thus thermal loss occurs, so that the heat using efficiency of the boiler (auxiliary heat source) is lowered.

SUMMARY OF THE INVENTION

Therefore, an object of the present invention is to provide an air conditioner that can enhance the heat using efficiency of an auxiliary heat source.

In order to attain the above object, an air conditioner equipped with a heat-source side unit comprising a compressor having a refrigerant discharge pipe and a refrigerant suction pipe and a heat-source side heat exchanger, plural use-side units each having a use-side heat exchanger and an inter-unit pipe that comprises a high-pressure gas pipe branched and connected to the refrigerant discharge pipe, a low-pressure gas pipe branched and connected to the refrigerant suction pipe and a liquid pipe connected to the heat-source side heat exchanger and through which the heat-source side unit is connected to the plural use-side units, the heat-source side heat exchanger being branched and connected to the refrigerant discharge pipe and the refrigerant suction pipe of the compressor through a change-over valve, each of the use-side heat exchangers being branched and connected to the high-pressure gas pipe and the low-pressure gas pipe through a change-over valve and an expansion valve being connected to the liquid pipe, thereby forming a refrigerant circuit, further comprises: an auxiliary heat source unit having a water-refrigerant heat exchanger for heat-exchanging refrigerant with water, a refrigerant side of the water-refrigerant heat exchanger being selectively connectable to one of the high-pressure gas pipe and the low-pressure gas pile through one of a first change-over valve and a second change-over valve, and also connected to the liquid pipe through an expansion valve; and a controller for controlling the auxiliary heat source unit so that the water-refrigerant heat exchanger of the auxiliary heat source unit functions as an evaporator with a water side thereof serving as a heat source when some of the user-side units are under heating operation.

It is preferable that the above air conditioner is further equipped with a heat-exchange unit connected to the water side of the water-refrigerant heat exchanger of the auxiliary heat source unit, wherein the heat source of the water side of the water-refrigerant heat exchanger is made to function as a heat source for the heat-exchange unit.

In the above air conditioner, it is preferable that the controller controls the auxiliary heat source unit so that the water-refrigerant heat exchanger functions as an evaporator with the water side of the water-refrigerant heat exchanger serving as a heat source when outside air temperature is less than a predetermined threshold temperature at which required heating capacity from the use-side units cannot be output during the heating operation of the use-side units.

In the above air conditioner, it is preferable that the predetermined threshold temperature is varied in accordance with the required heating capacity.

In the above air conditioner, it is preferable that the corresponding relationship between the required heating capacity and the predetermined threshold temperature is set as a data base in advance, and the controller specifies the predetermined threshold temperature corresponding to the present required heating capacity by referring to the data base, and judges whether the outside air temperature is less than the predetermined threshold temperature.

In the above air conditioner, it is preferable that the auxiliary heat source unit contains a boiler at the water side of the water-refrigerant heat exchanger thereof.

In the above air conditioner, it is preferable that most of the auxiliary heat source unit is disposed indoors and the boiler is disposed outdoors.

According to the air conditioner of the present invention, such a situation that the water-refrigerant heat exchange is cooled by the outside air can be avoided, and thus the heat using efficiency of the auxiliary heat source unit can be enhanced.

Furthermore, the heat source of the water side of the water-refrigerant heat exchanger can be used as the heat source of the heat exchange unit, and thus the heating operation of the heat exchange unit can be performed even under the condition that the heat source is insufficient by only air heating.

Still furthermore, the heat source of the water side of the water-refrigerant heat exchanger is made to function as an evaporator with the water side thereof serving as a heat source, so that the required heating capacity can be output even when the outside air temperature is low.

BRIEF DESCRIPTION OF THE DRAWINGS

FIG. 9 is a diagram showing flow of refrigerant and water when the outside air temperature is not less than the threshold temperature and the floor heating panel is turned on;

FIG. 11 is a diagram showing flow of refrigerant and water when the outside air temperature is less than the threshold temperature and the floor heating panel is turned on.

DETAILED DESCRIPTION OF THE PREFERRED EMBODIMENTS

Preferred embodiments According to the present invention will be described hereunder with reference to the accompanying drawings.

First Embodiment

Figure 1:
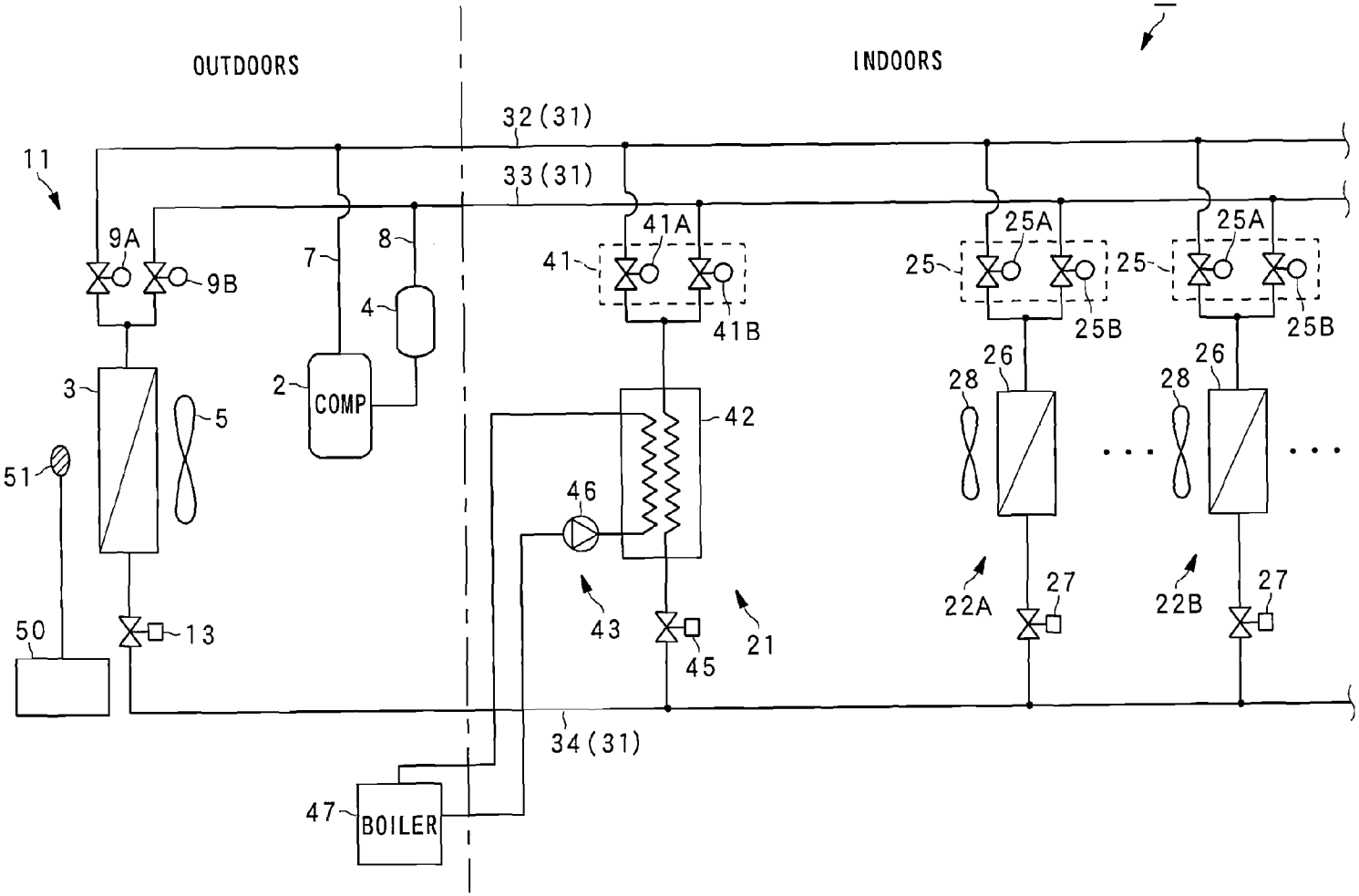
FIG. 1 is a diagram showing the construction of an air conditioner according to a first embodiment.

FIG. 1 is a diagram showing the construction of an air conditioner 1 according to a first embodiment of the present invention.

The air conditioner 1 contains a heat-source side unit 11 disposed outdoors and plural use-side units 22A, 22B, etc. disposed indoors. The heat-source side unit 11 is connected to the plural use-side units 22A, 22B, etc. through an inter-unit pipe 31, and an auxiliary heat source unit described later is connected to the inter-unit pipe 31.

The heat-source unit 11 has a compressor 2, a heat-source side heat exchanger 3 and a gas-liquid separator 4, and one end of the heat-source side heat exchanger 3 is branched and connected to a refrigerant discharge pipe 7 and a refrigerant suction pipe 8 of the compressor 2 through change-over valves 9A and 9B, and the inter-unit pipe 31 is connected to a high-pressure gas pipe 32 which is branched and connected to the refrigerant discharge pipe 7, a low-pressure gas pipe 33 which is branched and connected to the refrigerant suction pipe 8, and a liquid pipe 34 which is connected to the other end of the heat-source side heat exchanger 3 through an electrically-driven expansion valve 13.

Each of the use-side units 22A, 22B, etc. is a use-side unit for air-conditioning a room, and it is equipped with an electromagnetic valve kit 25 and a use-side heat exchanger 26. One end of the use-side heat exchanger 26 is branched and connected to the high-pressure gas pipe 32 and the low pressure gas pipe 33 through change-over valves 25A, 25B disposed in each electromagnetic valve kit 25, and the other end of each use-side heat exchanger 26 is connected to the liquid pipe 34 through an electrically-driven expansion valve 27, thereby constituting a refrigerant circuit in which refrigerant discharged from the compressor 2 is circulated through the heat-source side heat exchanger 3 and the use-side heat exchanger 26 as described in detail later.

The heat-source side heat exchanger 3 is an air-refrigerant heat exchanger for heat-exchanging refrigerant and air, and an air blowing fan 5 is disposed in proximity to the heat-source side heat exchanger 3. Outside air (outdoor air) is made to flow through the heat-source side heat exchanger 3 by the air blowing fan 5 to promote the heat-exchange between the refrigerant and the outside air.

Furthermore, the use-side heat exchanger 26 is an air-refrigerant heat exchanger for heat-exchanging refrigerant and air (indoor air), and an air blowing fan 28 is disposed in proximity to each use-side heat exchanger 26. Indoor air is made to flow through each use-side heat exchanger 26 by each air blowing fan 28 to promote the heat-exchange between the indoor and the refrigerant.

The auxiliary heat-source unit comprises the electromagnetic valve kit 41, a water-refrigerant heat exchanger 42, an electrically-driven expansion valve 45, and a water circuit 43 connected to the water side of the water-refrigerant heat exchanger 42. One end of the refrigerant side of the water-refrigerant heat exchanger 42 is branched and connected to the high-pressure gas pipe 32 and the low-pressure gas pipe 33 through change-over valves (first change-over valve and second change-over valve) 41A, 41B disposed in the electromagnetic valve kit 41, and the other end of the water-refrigerant heat exchanger 42 is connected to the liquid pipe 34 through the electrically-driven expansion valve 45. The water circuit 43 contains a pipe through which water flows, a pump 46 and a boiler 47. Therefore, by operating the pump 46 and the boiler 47, the auxiliary heat source unit makes hot water flow through the water-refrigerant heat exchanger 42 and evaporates refrigerant by the heat of the hot water in the water-refrigerant heat exchanger 42, that is, the auxiliary heat source unit serves as an auxiliary heat source for supplying evaporation heat to the refrigerant.

Figure 2:
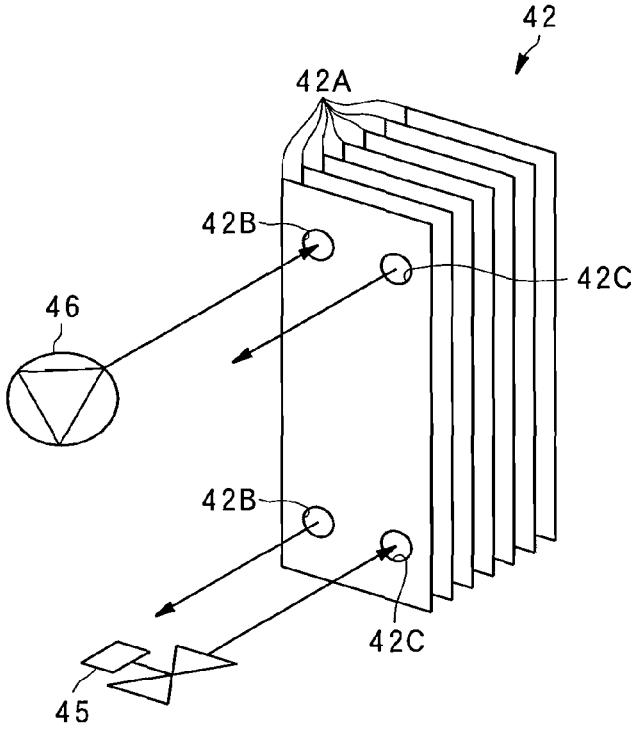
FIG. 2 is a perspective view showing a water-refrigerant heat exchanger.

As shown in FIG. 2, a plate type heat exchanger in which flow passages of two systems (a water flow passage 42B and a refrigerant flow passage 42C) are constructed through plural heat transfer plates 42A is applied as the water-refrigerant heat exchanger 42. Heat is transferred between two kinds of fluid (refrigerant and water) flowing through the flow passages 42B, 42C by the heat transfer plates 42A. Therefore, the capacity (volume) of the water-refrigerant heat exchanger 42 can easily changed (increased or reduced) by changing (increasing or reducing) the number of the heat transfer plates 42A. Furthermore, in the auxiliary heat source unit 40, the boiler 47 and only a part of the water circuit 43 containing the boiler 47 are disposed outdoors, and the other portions (the electromagnetic valve kit 41, the water-refrigerant heat exchanger 42, the expansion valve 45, and most of the water circuit 43 containing the pump 46) are disposed indoors as shown in FIG. 1, whereby the portions to be disposed outdoors are limited to the minimum level.

A controller 50 is disposed in the heat-source side unit 11 of the air conditioner 1, and also an outside air temperature sensor 51 which is wired and connected to the controller 50 is disposed in the heat-source side unit 11. The controller 50 controls the respective parts of the heat-source side unit 11 and the use-side units 21, 22A, 22B, . . . , etc. (containing the auxiliary heat source unit), and also the outside air temperature is detected by the outside air temperature sensor 51.

Next, the air-conditioning operation will be described. When all rooms are subjected to cooling operation at the same time by the use-side units 22A, 22B, etc., one change-over valve 9A of the heat-source side heat exchanger 3 is opened while the other change-over valve 9B is closed, one change-over valve 25A of each use-side heat exchanger 26 is closed while the other change-over valve 25B is opened, and also the air blowing fans 5, 28 are actuated, whereby refrigerant discharged from the compressor 2 successively flows through the refrigerant discharge pipe 7, the change-over valve 9A, the heat-source side heat exchanger 3 and the expansion valve 13, and is condensed and liquefied in the expansion valve 13. Thereafter, the liquefied refrigerant is passed through the liquid pipe 34 and distributed to the expansion valves 27 of the respective use-side units 22A, 22B, etc. to be reduced in pressure. Thereafter, the refrigerant is evaporated in each use-side heat exchanger 26, successively passed through change-over valve 25B, the low-pressure gas pipe 33, the refrigerant suction pipe 8 and the gas-liquid separator 4 and then sucked into the compressor 2. The heat-source side heat exchanger 3 acts as an air-cooling condenser as described above, and the plural use-side heat exchangers 26 act as air-cooling evaporators, so that all the rooms are cooled by the plural use-side heat exchangers 26.

Under this cooling operation (all the use-side units 22A, 22B, etc. carry out the cooling operation), the change-over valves (the first change-over valve and the second change-over valve) 41A, 41B are closed, and also the pump 46 and the boiler 47 are stopped, so that the auxiliary heat source unit is kept under a stopped state.

On the other hand, when all the rooms are heated at the same time, one change-over valve 9A of the heat-source side heat exchanger 3 is closed while the other change-over valve 9B is opened, and one change-over valve 25A of each use-side heat exchanger 26 is opened while the other change-over valve 25B is closed, so that refrigerant discharged from the compressor 2 is successively passed through the refrigerant discharge pipe 7 and the high-pressure gas pipe 32 and then distributed to the change-over valve 25A and the use-side heat exchanger 26. The distributed refrigerant is condensed and liquefied in each use-side heat exchanger 26, reduced in pressure by each expansion valve 27 and then joined together in the liquid pipe 34. Thereafter, the refrigerant is evaporated in the heat-source side heat exchanger 3, successively passed through the change-over valve 9B, the refrigerant suction pipe 8 and the gas-liquid separator 4 and then sucked into the compressor 2. As described above, the heat-source side heat exchanger 3 acts as an air-cooling evaporator, and all the rooms are heated by the plural use-side heat exchangers 26 acting as air-cooling condensers.

Furthermore, when both the cooling operation and the heating operation are carried out in a mixing mode, for example when the use-side unit 22A carries out the cooling operation and the use-side unit 22B carries out the heating operation, one change-over valve 9A of the heat-source side heat exchanger 3 is opened while the other change-over valve 9B is closed, one change-over valve 25A of the use-side unit 22A under cooling operation is closed while the other change-over valve 25B is closed, and one change-over valve 25A of the use-side unit 22B under heating is opened while the other change-over valve 25B is closed, so that a part of the refrigerant discharged from the compressor 2 is successively passed through the refrigerant discharge pipe 7 and the change-over valve 9A, and then flows to the heat-source side heat exchanger 3. In addition, the residual refrigerant is passed through the high-pressure gas pipe 32 and flows through the change-over valve and the use-side heat exchanger 26 of the use-side unit 22B under heating operation. The refrigerant is condensed and liquefied in the use-side heat exchanger 26 and the heat-source side heat exchanger 3.

The refrigerant condensed and liquefied in the heat exchangers 26, 3 is passed through the liquid pipe 34, reduced in pressure by the expansion valve 27 of the use-side unit 22A, and then evaporated in the use-side heat exchanger 26. Thereafter, the refrigerant passes through each change-over valve 25B, flows through the low-pressure gas pipe 33, successively passes through the refrigerant suction pipe 8 and the gas-liquid separator 4, and then is sucked into the compressor 2. As described above, one room is heated by the use-side heat exchanger 26 acting as the condenser, and the other room is cooled by the other use-side heat exchanger 26 acting as the evaporator. Under the cooling/heating mixing operation, the expansion valve 27 of the use-side unit 22B is fully opened to prevent occurrence of pressure loss of the refrigerant, and also the pressure adjustment is carried out by the expansion valve 13 of the heat-source side unit 11 so that the liquefied refrigerant pressure in the liquid pipe 34 is not unbalanced.

Under the air-conditioning operation described above, the controller 50 obtains data on indoor temperature values and target temperature values for rooms to be respectively air-conditioned by the use-side units 22A, 22B, etc., calculates the required capacity (required cooling capacity, required heating capacity) on the basis of the temperature difference between the indoor temperature and the target temperature of each room, and controls the rotating frequency of the compressor 2 so that the required capacity is satisfied.

Figures 3, 4:
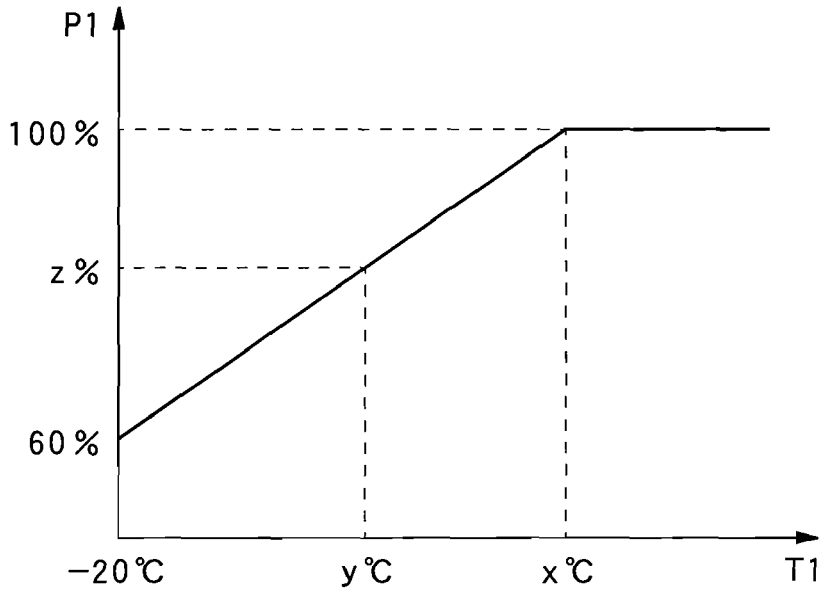
FIG. 3 is a diagram showing a situation that a required heating capacity is not output.
FIG. 4 is a diagram showing an example of judgment information for specifying a threshold temperature at which the required heating capacity cannot be secured.

Under heating operation, the quantity of heat to be pumped up by the heat-source side heat exchanger 3 is reduced as the outside air temperature T1 around the heat-source side unit 11 is lower, and thus there occurs such a situation that the required heating capacity (hereinafter referred to as a required heating capacity P1) cannot be output even when the compressor 2 is operated at the upper-limit rotational frequency under some outside air temperature T1. Specifically, as shown in FIG. 3, if the outside air temperature T1 is not less than x° C., 100% of the required heating capacity P1 can be output. However, if the outside air temperature T1 is reduced to y° C. (less than x° C.), only z % (z %<100%) of the required heating capacity P1 is output. Furthermore, in the example of FIG. 3, when the outside temperature T is equal to −20° C., only about 60% of the required heating capacity is output. Here, the threshold temperature x° C. is varied in accordance with the required heating capacity P1, and it is higher as the required heating capacity P1 is higher.

Therefore, according to this embodiment, judgment information for judging whether the outside temperature T1 is reduced to a value less than the threshold temperature x° C. at which required heating capacity P1 from the user-side units 22A, 22B, etc. cannot be secured is held in advance, and when it is judged on the basis of this judgment information that there will occur a situation that the required heating capacity P1 cannot be output, the auxiliary heat-source unit is driven to compensate for the deficiency of the heat source.

FIG. 4 is a diagram showing an example of the judgment information described above.

In FIG. 1, there is provided a table data (data base) D1 (judgment information) indicating the corresponding relationship between the required heating capacity P1 and the threshold temperature x° C. In the table data D1, the threshold temperature values corresponding to the required heating capacities PlA, P1B, PlC, etc. are represented by xA, xB, XC, etc. In this embodiment, another table data with which it can be judged from the combination of the required heating capacity P1 and the outside air temperature T1 whether the outside temperature T1 is less than the threshold temperature x° C. may be used in place of the table data D1. Or, the corresponding relationship between the required heating capacity P1 and the threshold temperature x° C. may be represented by a mathematical expression. In this case, the present required heating capacity P1 is substituted into the mathematical expression to specify the threshold temperature x° C.

Next, the control of the auxiliary heat source unit will be described.

Figure 5:
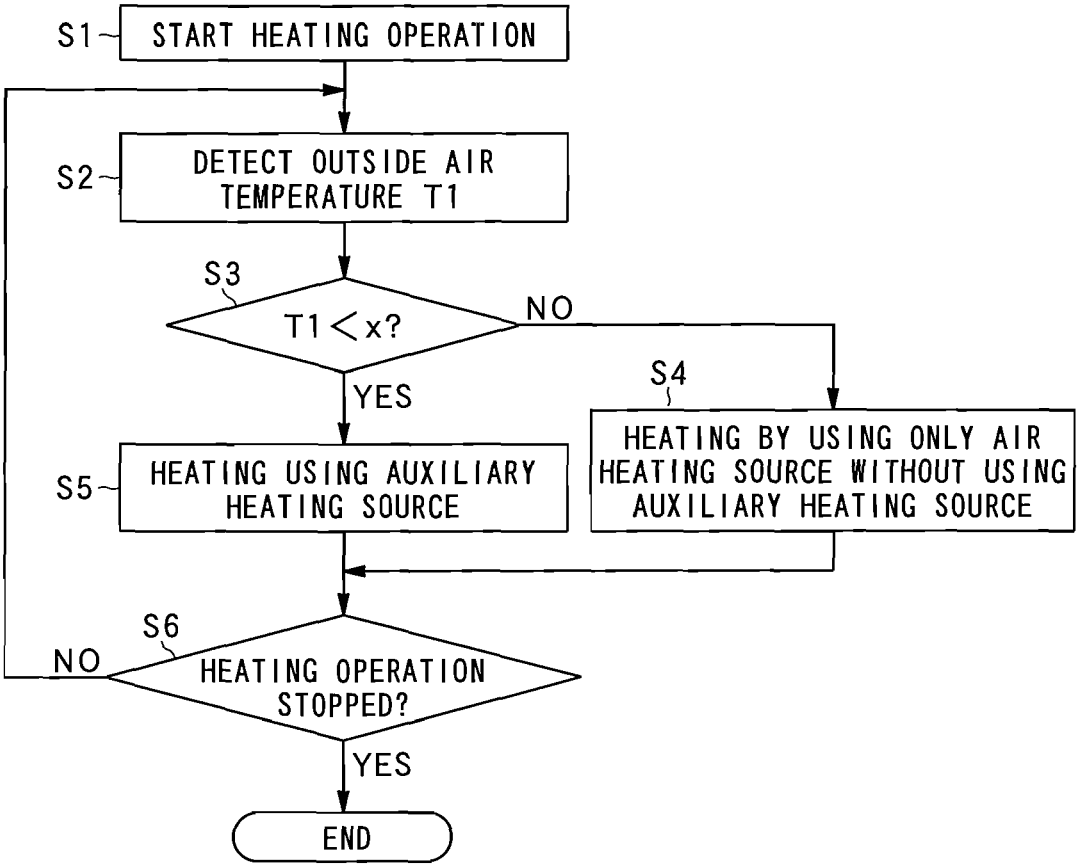
FIG. 5 is a diagram showing a control flow of an auxiliary heat source unit.

FIG. 5 is a diagram showing the control flow of the auxiliary heat source unit. This control flow is executed when the heating operation is started by some (at least one or all) of the use-in unit 22A, 22B, etc. (step S1).

First, the controller 50 detects the outside air temperature T1 by the outside air temperature sensor (step S2), and then the controller 50 specifies the threshold temperature x° C. corresponding to the present required heating capacity P1 by referring the above judgment information, and judges whether the detected outside air temperature T1 is less than the threshold temperature x° C. (step S3).

In this case, if the outside air temperature T1 is less than the threshold temperature x° C. (step S3: NO), the controller 50 closes the change-over valves 41A, 41B, and also keeps the pump 46 and the boiler 47 under the stopped state, that is, keeps the auxiliary heat source unit under the stopped state, whereby the heating operation based on only the air heat source at the heat source side unit is continued (step S4).

Figure 6:
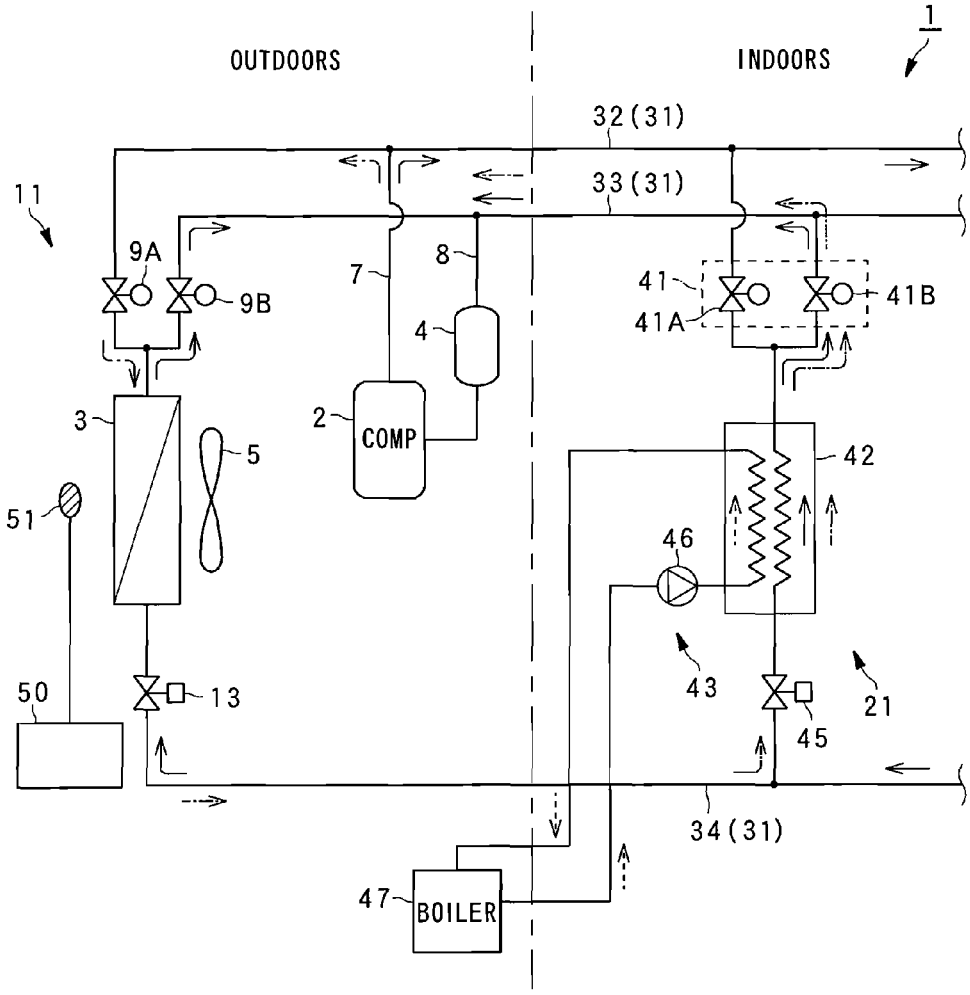
FIG. 6 is a diagram showing flow of water and water when the outside air temperature is less than the threshold temperature.

On the other hand, if the outside air temperature T1 is less than the threshold temperature x° C. (step S3: YES), the controller 50 closes the change-over valve (first change-over valve) 41A while opening the change-over valve (second change-over valve) 41B, and also actuate the pump 46 and the boiler 47 (step S5). Therefore, as indicated by solid-line arrows of FIG. 6 representing the refrigerant flow, the refrigerant discharged from the compressor 2 passes through the use-side unit (at least one of 22A, 22B, etc.) under heating operation to be condensed and liquefied, and then flows to the liquid pipe 34. A part of the liquefied refrigerant flowing to the liquid pipe 34 flows to the water-refrigerant heat exchanger 42 through the expansion valve 45. In addition, as indicated by broken-line arrows of FIG. 6 representing the water flow, water heated in the boiler 47 flows to the water-refrigerant heat exchanger 42, and the liquefied refrigerant is evaporated in the water-refrigerant heat exchanger 42. Thereafter, the evaporated refrigerant is passed through the change-over valve 41B, the low-pressure gas pipe 33, the refrigerant suction pipe 8 and the gas-liquid separator 4, and then sucked into the compressor 2.

As described above, the water-refrigerant heat exchanger 42 is made to function as an evaporator to withdraw the heat of the auxiliary heat source unit as refrigerant heat, and thus the heating capacity of the air conditioner 1 can be enhanced. In addition, the water-refrigerant heat exchanger 42 and most of the water circuit 43 are disposed indoors, so that these units are prevented from being cooled by cold outside air and thus the heat loss caused by the outside air can be reduced. Accordingly, the heat using efficiency of the auxiliary heat source (boiler 47) can be enhanced, and the required heating capacity P1 can be output even when the outside air temperature T1 is less than the threshold temperature x° C. at which the required heating capacity P1 cannot be secured.

Subsequently, the controller 50 judges whether the heating operation is stopped or not (step S6). If the heating operation is continued (step S6: NO), the processing of the steps S1 to S5 (or S4) is repetitively executed. If the heating operation is stopped (step S6: YES), the change-over valves (the first change-over valve and the second change-over valve) 41A, 41B are closed, and the pump 46 and the boiler 7 are set to the stopped state, thereafter finishing the processing concerned.

Furthermore, in the air conditioner 1, under defrosting operation of the heat-source side heat exchanger 3, that is, when the change-over valve 9A is opened and the other change-over valve 9B is closed so that the high-pressure refrigerant in the high-pressure gas pipe 32 is made to flow through the heat-source side heat exchanger 3 as indicated by one-dotted chain line arrows of FIG. 6 representing the refrigerant flow, the change-over valve (the first change-over valve) 41A is closed, the change-over valve (the second change-over valve) 41B and the expansion valve 45 are opened, and the pump 46 and the boiler 47 are actuated so that water heated in the boiler 47 is made to flow through the water-refrigerant heat exchanger 42 to evaporate the liquid refrigerant in the water-refrigerant heat exchanger 42. As described above, the water-refrigerant heat exchanger 42 is made to function as an evaporator with the water side thereof serving as a heat source, whereby the refrigerant temperature can be increased to enhance the defrosting capacity and thus the defrosting time can be shortened.

As described above, the air conditioner 1 of this embodiment has the auxiliary heat source unit which is disposed indoors and has the electromagnetic valve kit 41, the water-refrigerant heat exchanger 42 and the water circuit 43, and the water-refrigerant heat exchanger 42 is made to function as an evaporator with the water side thereof serving as a heat source under the heating operation of the use-side units 22A, 22B. Therefore, such a situation that the water-refrigerant heat exchanger 42, etc. are cooled by the outside air can be avoided, and thus the heat loss can be reduced. Accordingly, the heat using efficiency of the auxiliary heat source unit can be enhanced irrespective of the outside air temperature. As a result, the temperature range in which the required heating capacity P1 can be obtained can be expanded to a lower temperature range, and the reduction of the heating capacity when the outside temperature is low in the winter season or the like. In other words, there can be implemented an air conditioner 1 suitable for a cold district in which deficiency of heat source is liable to occur in the air heat source because of the low outside air temperature T1.

In addition, according to this embodiment, the auxiliary heat source unit is used only when the outside air temperature T1 is reduced to a low temperature (threshold temperature x° C.) or less at which the required heating capacity P1 cannot be secured, and thus the auxiliary heat source unit can be avoided from being needlessly operated.

Second Embodiment

Figure 7:
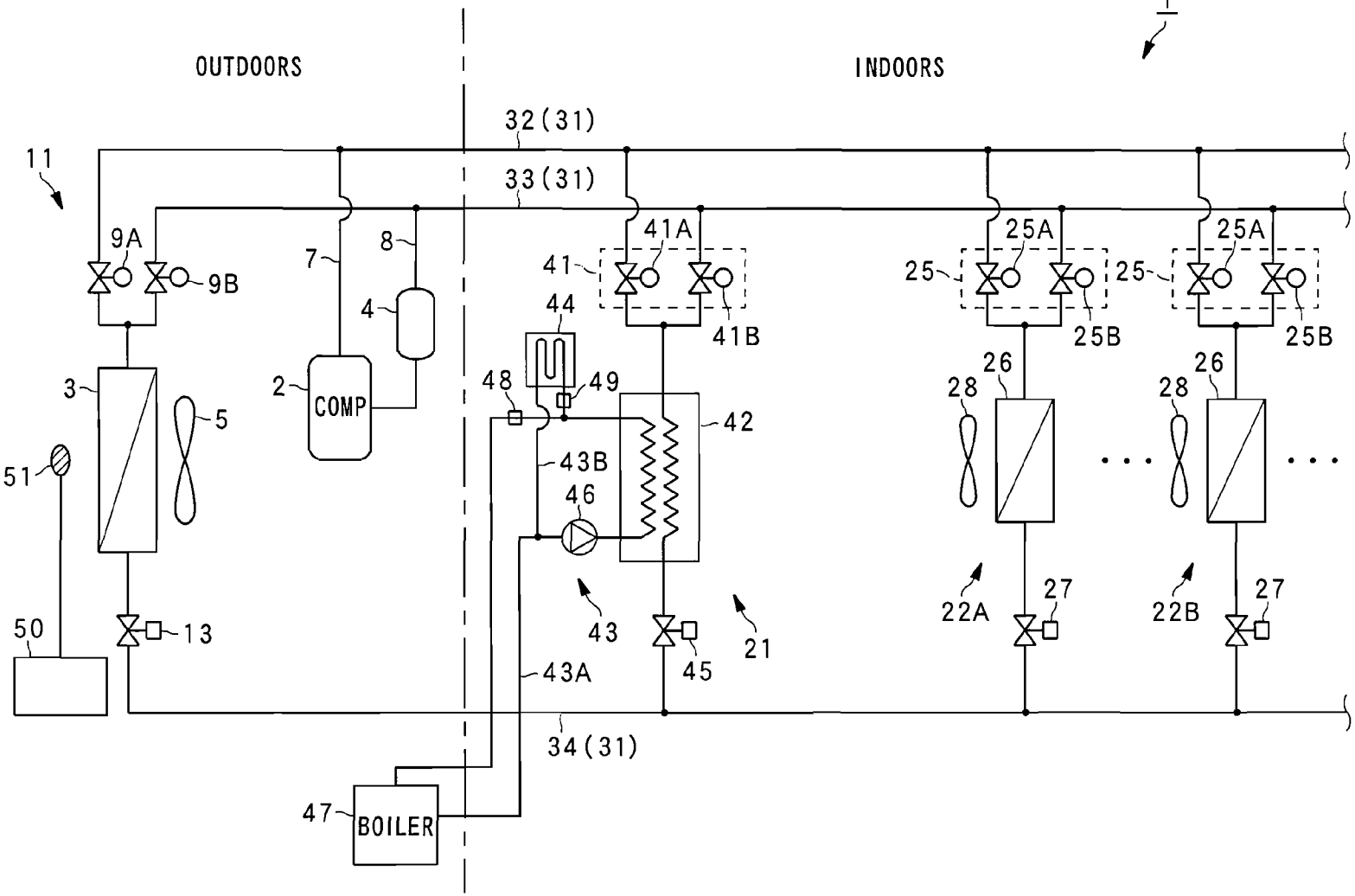
FIG. 7 is a diagram showing the construction of an air conditioner according to a second embodiment.

FIG. 7 is a diagram showing the construction of an air conditioner 1 according to a second embodiment. In the second embodiment, a floor heating panel 44 is disposed in the water circuit 43. The substantially same constituent elements as the first embodiment are represented by the same reference numerals, and the duplicative description thereof is omitted. Different portions will be described in detail.

The floor heating panel 44 warms air (indoor air) in the neighborhood of the floor surface by radiation heat to carry out heating operation. The floor heating panel 44 and one use-side unit 22A are disposed in the same room.

Describing in more detail, the floor heating panel 44 functions as a water-air heat-exchanging unit for heat-exchanging water flowing through the water circuit 43 with indoor air. The water circuit 43 is equipped with an auxiliary heat source circulating passage (first circulating passage) 43A for circulating water between the boiler 47 and the water-refrigerant heat exchanger 42, a floor heating circulating passage (second circulating passage) 43B that is branched from the auxiliary heat source circulating passage 43A and circulates water between the floor heating panel 44 and the water-refrigerant heat exchanger 42, a change-over valve 48 for allowing/prohibiting the circulation of water to the auxiliary heat source circulating passage 43A, and a change-over valve 49 for allowing/prohibiting the circulation of water to the floor heating circulating passage 43B.

Figure 8:
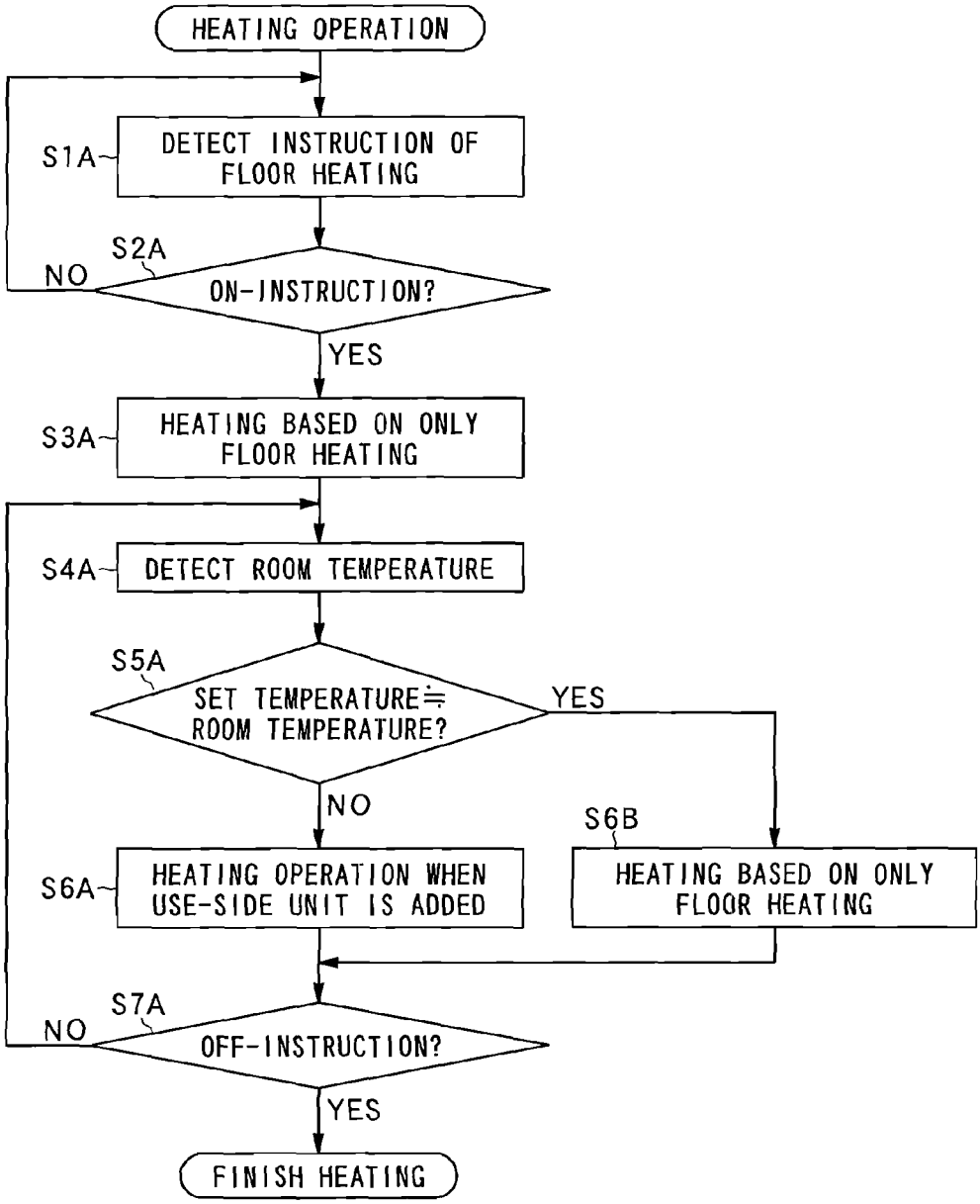
FIG. 8 is a diagram showing a control flow of a floor heating panel.

FIG. 8 is a diagram showing the control flow of the heating operation. This control flow is the control flow for the heating operation of a room (hereinafter referred to as a first room) in which the floor heating panel 44 and the use-side unit 22A are set. In another room in which the use-side unit 22B is set (hereinafter referred to as a second room), when the heating operation of this use-side unit 22B is instructed, the heating operation based on the use-side unit 22B is carried out to heat the second room as in the case of the first embodiment. In this case, it is assumed that the compressor 2 is operated.

First, the controller 50 detects whether a driving instruction of the floor heating panel 44 (a heating operation instruction of the first room) is input by an operating device set in the first room (step S1A). If the controller 50 detects an ON-instruction (operation instruction) of the floor heating panel 44 (step S2A: YES), it opens the change-over valve 49 and also actuates the pump 46, and circulates water in the auxiliary heat source circulating passage 43A connecting the floor heating panel 44 and the water-refrigerant heat exchanger 42 so that the heating operation of only the floor heating panel 44 is carried out (step S3A).

Subsequently, the controller 50 detects the room temperature (indoor temperature) notified from the use-side unit 22A after a predetermined time elapses (step S4A), and if the detected room temperature is not substantially coincident with each other (step S5A: NO), one change-over valve 25A of the use-side unit 22A is opened, and also the other change-over valve 25B is closed, whereby the heating operation containing the heating operation of the use-side unit 22A is carried out (step S6A). If the room temperature is substantially coincident with the target temperature (step S5A: YES), when only the floor heating panel 44 is under heating operation, the heating operation concerned is continued, and the processing shifts to the subsequent step S7A. When the heating operation using both the floor heating panel 44 and the use-side unit 22A is carried out, the heating operation is changed to the heating operation of only the floor heating panel 44 (step S6B), and then the processing shifts to the subsequent step S7A.

Furthermore, the controller 50 judges whether an OFF-instruction (driving stop instruction) of the floor heating panel 44 is input or not. If no OFF instruction is input (step S7A: NO), the processing shifts to step S4A to repeats the processing of the steps S4A to S7A. If an OFF instruction is input (step S7A: YES), the heating operation is finished. That is, the heating operation of the room in which the floor heating panel 44 and the use-side unit 22A are provided is principally based on floor heating, that is, radiation heat, and secondly based on the heating of the use-side unit 22A, that is, the heating based on hot air. The heating of the use-side unit 22A is further carried out only when the heating capacity is deficient by only the floor heating. The floor heating (the heating based on radiation heat) is principally carried out as described above because the radiation heat heats the room by natural convection, and thus there can be supplied a heated environment under which the user does not feel air flow as compared with the hot air heating which heats the room by forced convection of air.

Next, the control and the flow of refrigerant and water when the outside air temperature T1 is not less than the threshold temperature x° C. under the heating operation described above and when the outside air temperature T1 is less than the threshold temperature x° C. under the heating operation will be described in detail.

When the outside air temperature T1 is not less than the threshold temperature x° C. under the heating operation, the controller 50 closes the change-over valve 48 and keeps the boiler 47 under the stopped state. In this case, when the floor heating panel 44 is turned off (the operation is stopped), the controller 50 keeps the change-over valve 49 under the closed state. when the floor heating panel 44 is turned on (during operation), the controller 50 opens the change-over valve 49, and actuates the pump 46. In addition, the controller 50 opens the change-over valve (first change-over valve) 41A and the expansion valve 45, and also closes the change-over valve (second change-over valve) 41B, so that water is made to flow through the floor heating circulating passage 43B to circulate water through the floor heating panel 44 as indicated by broken-line arrows of FIG. 9 representing the water flow.

Figure 9:
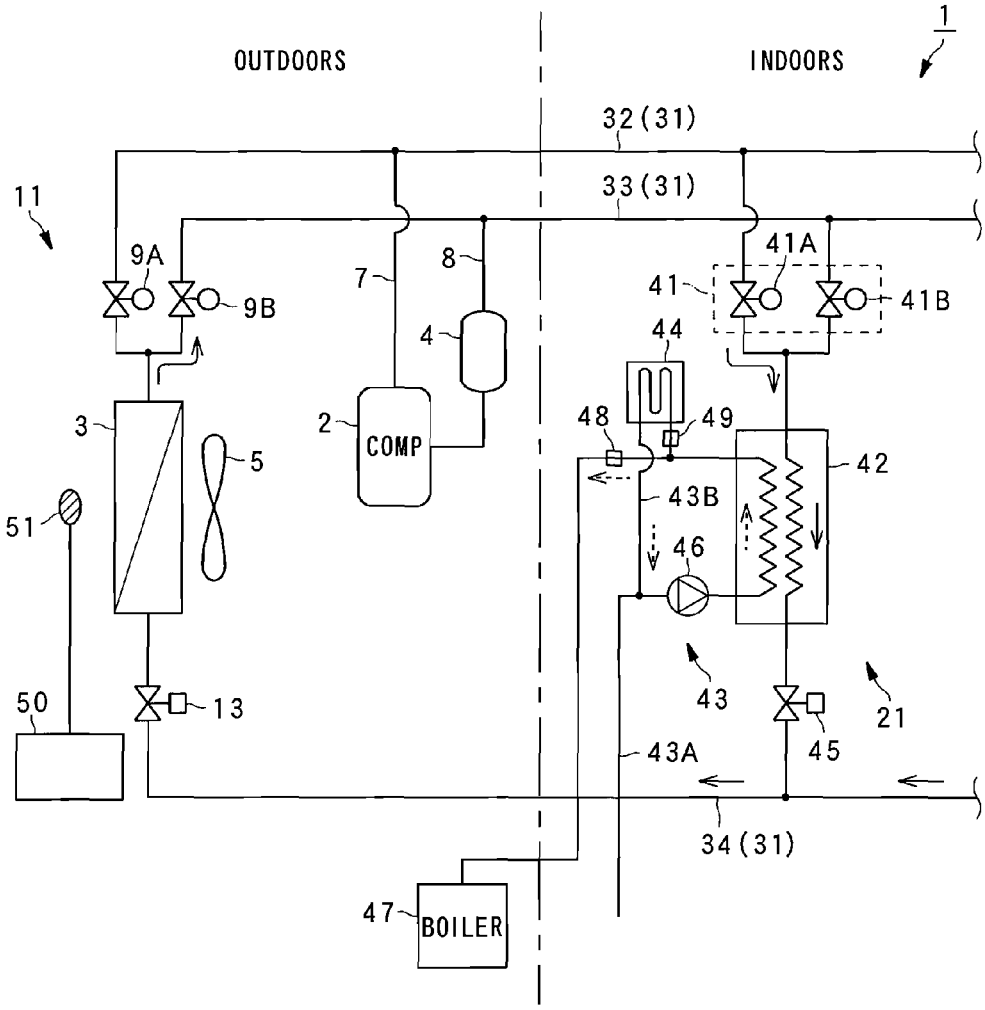

In this case, as indicated by solid-line arrows of FIG. 9 representing the refrigerant flow, the gas refrigerant flowing in the high-pressure gas pipe 32 passes through the change-over valve 41A and flows to the water-refrigerant heat exchanger 42. Accordingly, the gas refrigerant is condensed in the water-refrigerant heat exchanger 42, and water is heated by this condensation heat. The condensed and liquefied refrigerant is passed through the expansion valve 45 and flow together in the liquid pipe 34. Thereafter, the refrigerant is evaporated in the heat-source side heat exchanger 3, successively passed through the change-over valve 9B, the refrigerant suction pipe 8 and the gas-liquid separator 4, and then sucked into the compressor 2. As described above, the water-refrigerant heat exchanger 42 is made to function as a condenser, whereby water is heated by the condensation heat of the refrigerant and the heating operation can be performed by the floor heating panel 44. Furthermore, when the user-side units 22A, 22B, etc. are operated, as in the case of the first embodiment, one change-over valve 25A of each of the use-side units 22A, 22B, etc. is opened, and the other change-over valve 25B thereof is closed, whereby the heating operation is carried out by using the use-in side units 22A, 22B, etc.

Figure 10:
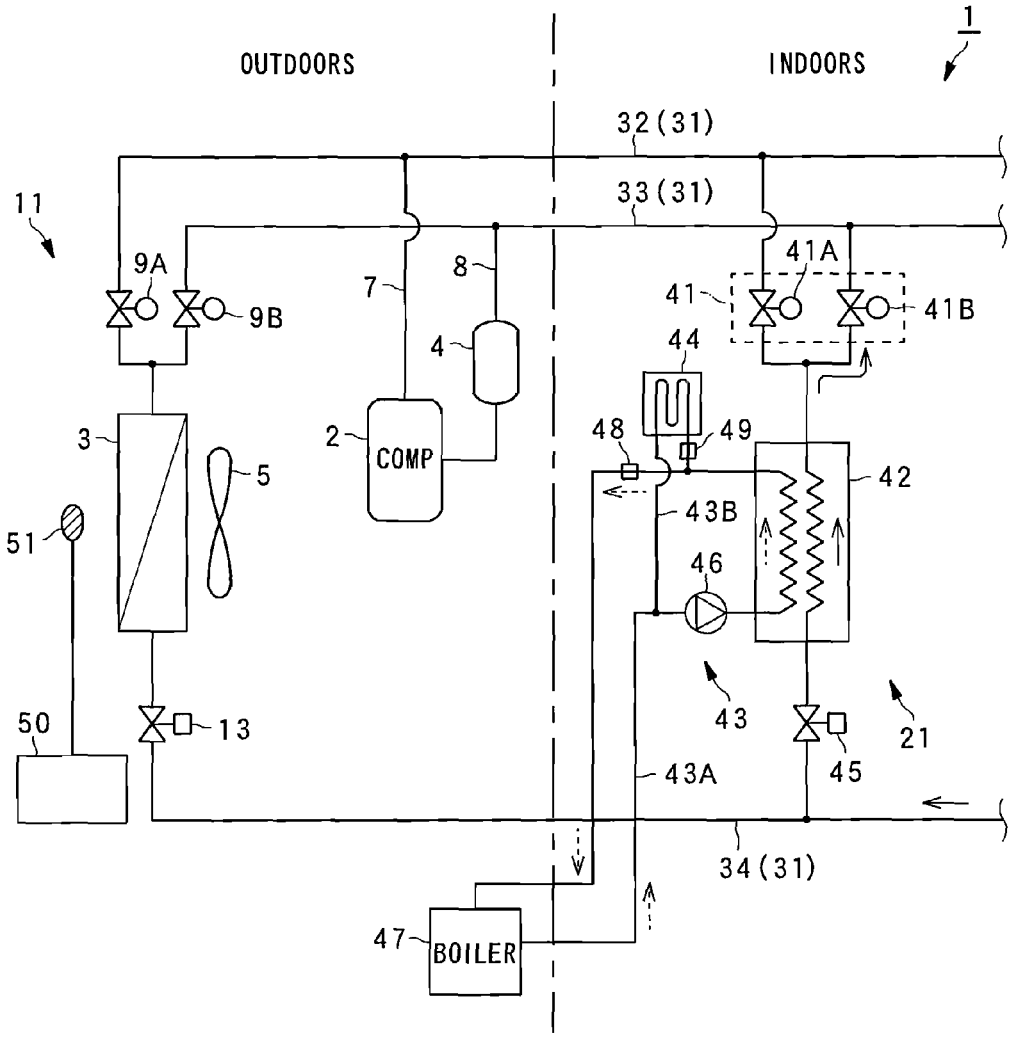
FIG. 10 is a diagram showing flow of refrigerant and water when the outside air temperature is less than the threshold temperature and the floor heating panel is turned off.

On the other hand, when the outside air temperature T1 is less than the threshold temperature x° C. under heating operation, the controller 50 executes the processing of step S5 in FIG. 5, closes the change-over valve (first change-over valve) 41A, opens the change-over valve (second change-over) 41B and makes the liquid refrigerant flowing through the liquid pipe 34 through the expansion valve 45 to the water-refrigerant heat exchanger 42 as indicated by solid-line arrows of FIG. 10 representing the refrigerant flow.

In this case, the controller 50 opens the change-over valve 48, and also operates the pump 46 and the boiler 47. If the floor heating panel 44 is turned off (the driving is stopped), the controller 50 keeps the change-over valve 49 under the closed state, and water heated in the boiler 47 is made to flow through the auxiliary heat source circulating circuit 43A and the heated water is made to flow to the water-refrigerant heat exchanger 42 as indicated by broken-line arrows of FIG. 10 representing the water flow. Accordingly, as in the case of the first embodiment, the liquid refrigerant is evaporated in the water-refrigerant heat exchanger 42, successively passed through the change-over valve 41B, the low-pressure gas pipe 33, the refrigerant suction pipe 8 and the gas-liquid separator 4, and then sucked into the compressor 2, whereby the heating capacity of the air conditioner 1 based on the use-side units 22B, etc. under operation can be enhanced by the heat source at the water side.

Figure 11:
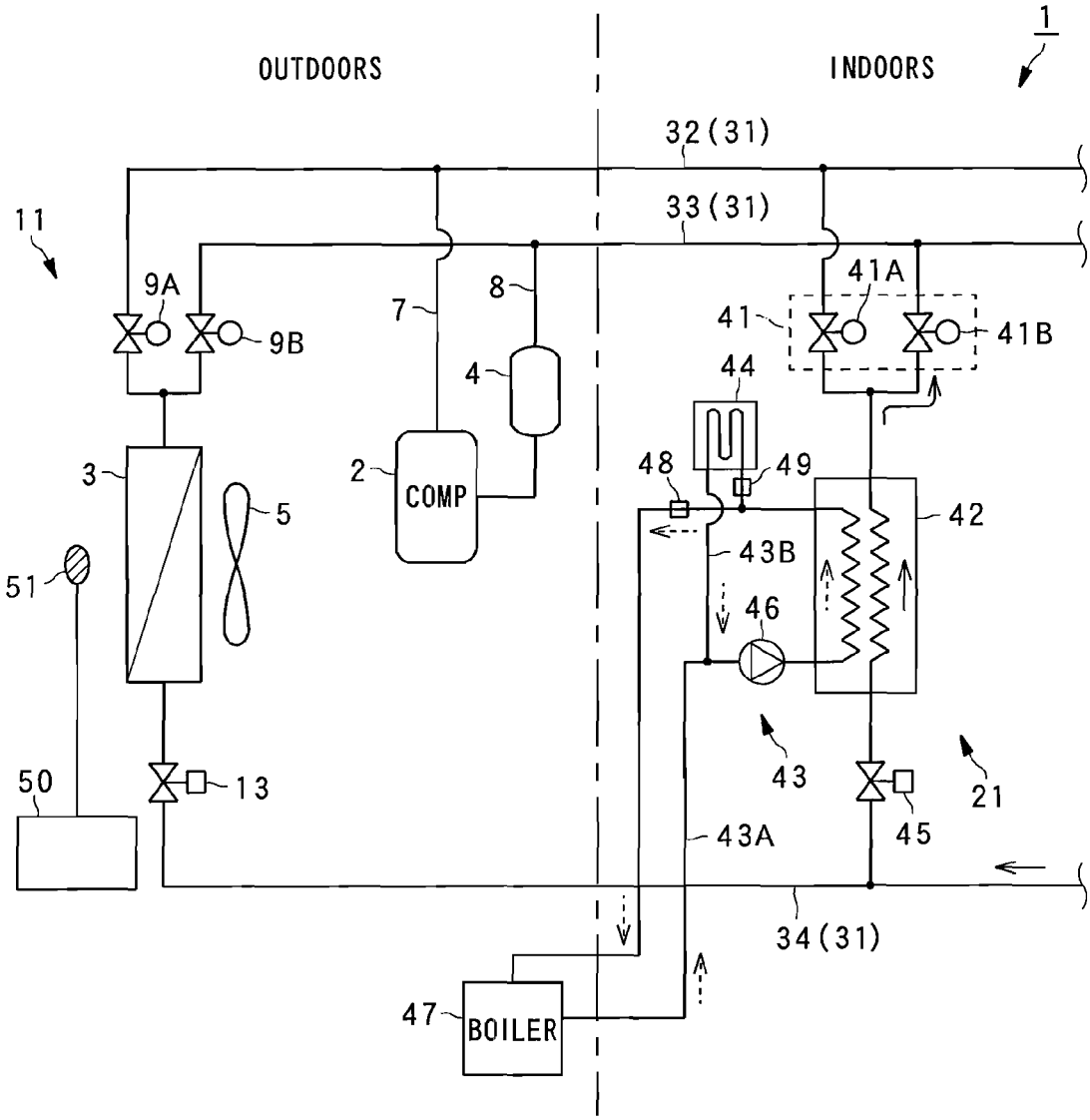

Furthermore, when the outside temperature T1 is less than the threshold temperature x° C., if the floor heating panel 44 is turned on (the driving is started), the controller 50 opens the change-over switch 48 is opened, operates the pump 46 and the boiler 47, and further opens the change-over valve 49. Therefore, as indicated by broken-line arrows of FIG. 11 representing the water flow, the water heated in the boiler 47 is made to flow through the auxiliary heat source circulating passage 43A and the floor heating circulating passage 43B branched from the passage 43A, and circulates water through the water-refrigerant heat exchanger 42 and the floor heating panel 44. Accordingly, the heating operation can be performed in the floor heating panel 44 by the heat source at the water side.

In this case, the liquid refrigerant is evaporated in the water-refrigerant heat exchanger 42, successively passed through the change-over valve 41B, the low-pressure gas pipe 33, the refrigerant suction pipe 8 and the gas-liquid separator 4, and sucked into the compressor 2, whereby the heating capacity of the air conditioner 1 based on the use-side units 22A, 22B, etc. under operation is enhanced by the heat source at the water side. Accordingly, even under the low outside temperature at which the heating capacity is lowered by only air heating, the reduction of the heating capacity by the use-side units 22A, 22B, etc. can be prevented by the auxiliary heat source unit 40, and also the floor heating operation can be also performed by the auxiliary heat source unit.

As described above, according to this embodiment, the floor heating panel 44 (corresponding to the water-air heat exchange unit for heat-exchanging water and indoor air) is connected to the water circuit 43 of the auxiliary heat source unit 40 having the water-refrigerant heat exchanger 42, and a part of the heats source of the auxiliary heat source unit is made to function as a heat source of the floor heating panel 44. Therefore, in addition to the effect of the first embodiment, the heating operation based on the floor heating panel 44 can be performed even under such a situation that deficiency of heat source occurs by using only air heat source, and there can be implemented the air conditioner 1 having the floor heating function which is suitable for cool districts.

Furthermore, the floor heating panel 44 is connected to the indoor disposed portion of the water circuit 43, and thus the heat loss caused by the outside air can be reduced. In addition, another heat exchange unit which is disposed indoors such as a radiation panel mounted on the wall or the like can be easily added.

The present invention is not limited to the above embodiment, and various modifications may be made to the above embodiment.

What is claimed is:

1. An air conditioner equipped with a heat-source side unit that is disposed outdoors and comprises a compressor having a refrigerant discharge pipe and a refrigerant suction pipe and a heat-source side heat exchanger, plural use-side units each having a use-side heat exchanger and an inter-unit pipe that comprises a high-pressure gas pipe branched and connected to the refrigerant discharge pipe, a low-pressure gas pipe branched and connected to the refrigerant suction pipe and a liquid pipe connected to the heat-source side heat exchanger and through which the heat-source side unit is connected to the plural use-side units, the heat-source side heat exchanger being branched and connected to the refrigerant discharge pipe and the refrigerant suction pipe of the compressor through a change-over valve, each of the use-side heat exchangers being branched and connected to the high-pressure gas pipe and the low-pressure gas pipe through a change-over valve and an expansion valve being connected to the liquid pipe, thereby forming a refrigerant circuit, further comprising:

an auxiliary heat source unit that is disposed indoors and has a water-refrigerant heat exchanger that heat-exchanges refrigerant wherein the water heating the liquid refrigerant, one end of a refrigerant side of the water-refrigerant heat exchanger being selectively connectable to one of the high-pressure gas refrigerant pipe and the low-pressure gas refrigerant pipe through one of a first change-over valve and a second change-over valve, and also the other end of the refrigerant side being connected to the liquid refrigerant pipe through an expansion valve; and a controller that controls the auxiliary heat source unit so that the water-refrigerant heat exchanger of the auxiliary heat source unit functions as an evaporator with a water side thereof serving as a heat source when some of the user-side units are under heating operation, wherein the auxiliary heat source unit contains a boiler at the water side of the water-refrigerant heat exchanger thereof.

2. The air conditional according to claim 1, further comprising a heat-exchange unit connected to the water side of the water-refrigerant heat exchanger of the auxiliary heat source unit, wherein the heat source of the water side of the water-refrigerant heat exchanger is made to function as a heat source for the heat-exchange unit.

3. The air conditioner according to claim 1, wherein the controller controls the auxiliary heat source unit so that the water-refrigerant heat exchanger functions as an evaporator with the water side of the water-refrigerant heat exchanger serving as a heat source when outside air temperature is less than a predetermined threshold temperature at which required heating capacity from the use-side units cannot be output during the heating operation of the use-side units.

4. The air conditioner according to claim 3, wherein the predetermined threshold temperature is varied in accordance with the required heating capacity.

5. The air conditioner according to claim 4, wherein the corresponding relationship between the required heating capacity and the predetermined threshold temperature is set as a data base in advance, and the controller specifies the predetermined threshold temperature corresponding to the present required heating capacity by referring to the data base, and judges whether the outside air temperature is less than the predetermined threshold temperature.

6. The air conditioner according to claim 1, wherein most of the auxiliary heat source unit is disposed indoors and the boiler is disposed outdoors.

* * * * *